US006154904A

United States Patent [19]

Ehredt

[11] Patent Number: 6,154,904

[45] Date of Patent: Dec. 5, 2000

[54] COMBINATION HEAD SUPPORT AND CARRY BAG

[76] Inventor: Jesse A. Ehredt, 1711 Duffton La., Painesville, Ohio 44077

[21] Appl. No.: 09/283,722

[22] Filed: Apr. 1, 1999

[51] Int. Cl.[7] ..... A47C 20/02

[52] U.S. Cl. ..... 5/639; 5/640; 5/643

[58] Field of Search ..... 5/622, 633, 634, 5/639, 643, 640

[56] References Cited

U.S. PATENT DOCUMENTS

| | | | |
|---|---|---|---|
| 2,663,029 | 12/1953 | Whitley et al. | 5/634 |
| 2,816,599 | 12/1957 | Adams . | |
| 3,120,008 | 2/1964 | Watson | 5/634 |
| 3,188,662 | 6/1965 | Watson | 5/633 |
| 3,237,215 | 3/1966 | Fried | 5/633 X |
| 3,292,189 | 12/1966 | Parker et al. | 5/634 X |
| 4,298,103 | 11/1981 | De Fries . | |
| 4,639,958 | 2/1987 | Lerner . | |
| 4,942,948 | 7/1990 | Vickers . | |
| 5,110,219 | 5/1992 | Lopes . | |
| 5,608,935 | 3/1997 | Warfield . | |
| 5,785,219 | 7/1998 | Kraft . | |

*Primary Examiner*—Terry Lee Melius
*Assistant Examiner*—Fredrick Conley
*Attorney, Agent, or Firm*—Thomas C. Saitta

[57] ABSTRACT

A combination head support and carry bag device having a cover encasing an internal frame assembly, where the frame assembly has a pair of base members pivotally joined to a pair of head support members, and a pair of post members pivotally joined to the free ends of the head support members, where an access opening is provided between the post members, and where the device can be positioned in an extended position with the post members connected to the base members or in a collapsed position with the post members disconnected from the base members.

18 Claims, 4 Drawing Sheets

COMBINATION HEAD SUPPORT AND CARRY BAG

BACKGROUND OF THE INVENTION

This invention relates generally to the field of devices which are used to support a person's head when reclining and to devices which are used for carrying articles, and in particular relates to combinations of such devices, where the carry bag also functions as a head rest.

In certain recreational pursuits, such as spending time at a beach or relaxing in a park, it is often most comfortable to lie down on the sand or ground, whether to sleep, read, tan, etc. It is usually more comfortable to have the head supported in a slightly forward inclined manner relative to the ground and the rest of the person's body, such as by a pillow or similar head support device. It is also common that various objects will be brought along, such as money, food, drinks, sunglasses, books, sun tan lotion, etc., so that the person will also usually bring a carry bag of some sort in which to carry and retain the objects. Rather than requiring the two devices—a head support and a carry bag, it would be advantageous to provide a combination head rest and carry bag, where the carry bag itself is structured to provide the desired head support for the user.

Examples of devices which address the issue of combining the head support with a carry bag include U.S. Pat. No. 2,816,599 to Adams, U.S. Pat. No. 4,298,103 to DeFries, U.S. Pat. No. 4,639,958 to Lerner, U.S. Pat. No. 4,942,948 to Vickers, U.S. Pat. No. 5,110,219 to Lopes, U.S. Pat. No. 5,608,935 to Warfield, and U.S. Pat. No. 5,785,219 to Kraft. The Adams device is a combination mat or towel with a wire support frame which can be folded to act as a carry bag. DeFries shows a cylindrical walled container with a removable end cap, the container sized so that a person's head can be supported when the container is laid on its side. Lerner shows a support frame with a flat bottom and curved upper surface, semi-circular in cross-section, with the frame supporting a cloth material which can be opened on one end. The Vickers and Lopes devices are rectangular carry bags which can be unfolded to create a mat. Warfield shows a rigid oblong support which has an inclined upper surface, where the top is removable. Kraft teaches a knapsack-type device with a fold out mat, the knapsack portion acting as a head support.

It is an object of this invention to provide an improved combination head support and carry bag of a structure which has not been heretofore created. It is an object to create such a combination head support and carry bag device which is generally wedge-shaped, where preferably the supporting framework is collapsible such that the height of the device when used as a head support is adjustable between a first extended position and a second collapsed position, with the first position providing the maximum incline and the second position providing both a lesser incline when used as a head support and a lesser width dimension when the device is used as a carry bag. It is a further object to provide such a device with an end flap closure, where the end flap is padded to create a pillow when the device is utilized as a head support, and further to provide the end flap with handle means for easier operation when the device is used as a carry bag.

SUMMARY OF THE INVENTION

The invention is a combination head support and carry bag device comprising a generally wedge-shaped support frame assembly encased within a cover, with preferably the frame assembly having pivot means such that the height of the device is adjustable when in use as a head support. The frame assembly comprises base members and head support members which are joined in a pivoting manner at an acute angle, and a pair of upright post members which are pivotally joined to either the base members or the head support members, with the non-joined end being connected to the other of either the base members or the head support members in a detachable manner, such that in the disconnected position with the device collapsed the angle between the base members and head support members is smaller than the angle when the upright post members are connected. This enables the device when used as a head support to be adjusted between a first extended position with a relatively high incline and a second collapsed position with a smaller incline, and further allows the device to adopt a minimum thickness profile when used as a carry bag or for storage when not in use. Preferably the ends of the head support members not connected directly to the base members are bent to form a shoulder such that the depending portion of the head support members prevent the device from collapsing totally when the upright post members are detached, such that the head support members define an inclined surface, but one of smaller angle than when the upright post members are connected.

The cover encases the frame assembly to create a container for objects, the cover defining connected top, bottom and side walls, provides a supporting web for the user's head when the device is used as a head support, and has an access opening positioned between the upright post members for placement and removal of items from the interior of the device. Preferably the cover is insulated and includes an end flap closure which hangs down to block the opening when the device is used as a head support, and which also preferably is padded such that the end flap can be flipped forward onto the top wall of the cover to act as a pillow. A handle or a carrying strap may also be provided to improve the efficiency of the device when it is used as a carry bag.

DETAILED DESCRIPTION OF THE INVENTION

With reference to the drawings, the invention will now be described in detail with regard for the best mode and the preferred embodiment. In its most general sense, the invention is a device which is a combination head support and carry bag. The device is a head support in that it has a generally wedge-shaped overall configuration such that a person may place the device onto the ground and use the inclined upper surface to support the user's head at a slight angle from the ground when the user reclines. The device is a carry bag, or more generally a container for retaining objects which can be grasped by the user and taken to different locations, in that the device has an accessible interior into which objects can be placed and removed. The preferred structure of the device, as set forth in detail below, allows the device to be configured in either an extended position with a maximum incline angle relative to the ground surface or in a collapsed position with a smaller incline angle, the collapsed position being the preferred position when the device is used as a carry bag.

Figure 1:
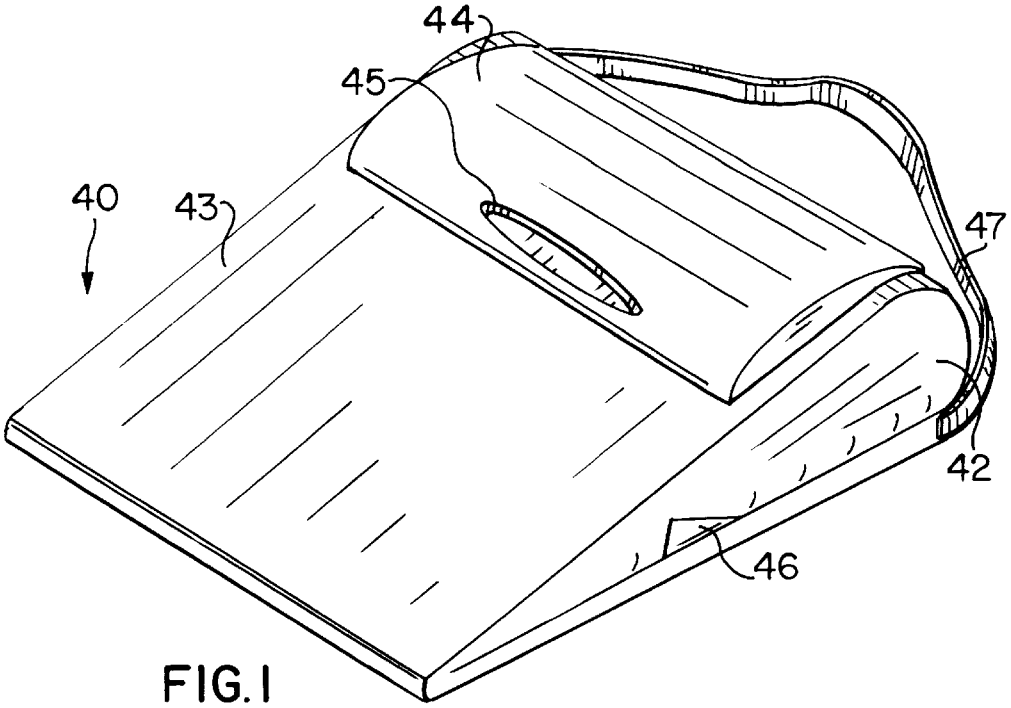
FIG. 1 is a perspective view from the front of the device, showing the device in the collapsed second position in use as a head support, with the end closure flap turned forward for use as a pillow.
Figure 2:
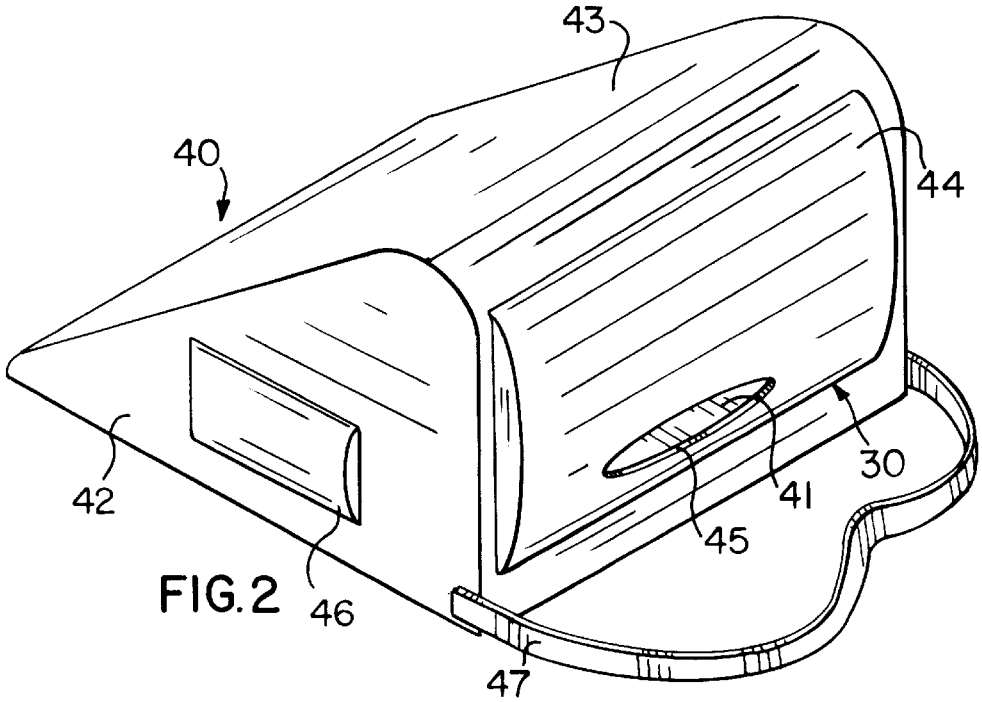
FIG. 2 is a perspective view from the back of the device, showing the device in the extended first position in use as a head support, with the end closure flap hanging down across the access opening.

As shown in FIGS. 1 and 2, the combination head support and carry bag device comprises a cover 40, which may be made of any suitably durable material, such as cloth, plastic, vinyl or the like, which has sufficient strength to support the head of a user when the material is stretched across the internal supporting frame assembly 10. Preferably the material forming the cover 40 acts as an insulator such that the device can function as a cooler for food or drink. The cover 40 comprises a bottom wall 41, a pair of side walls 42 and a top wall 43, all connected to define an enclosed interior with an access opening 30 to receive objects. As used herein, the bottom wall 41 designates the wall which is on the underside of the device and the top wall 43 designates the opposing wall which is the upper surface of the device when the device is placed on the ground for use as a head support. While bottom and top walls 41 and 43 may be made of a relative rigid material, side walls 42 must be made of a flexible material which allows them to fold when the device is adjusted from the extended position as shown in FIG. 2 to the collapsed position as shown in FIG. 1. Top wall 43 is preferably padded or formed of a thick material for comfort when in use as a head support.

The cover 40 may further comprise one or more pockets 46 located on side walls 42, with the opening for the pockets 46 preferably facing in the direction of the access opening 30 so that the pockets 46 will retain objects when the device is used as a carry bag, since during this usage the access opening 30 will be at the top of the device. An extended hand or shoulder strap 47 may also be connected to the device for ease of carry.

The access opening 30 is preferably a relatively large, generally rectangular opening through which objects can be easily inserted or removed. In the preferred embodiment, the cover 40 further comprises an end flap closure 44 which extends down from the top wall 43 and covers the access opening 30 when the device is used as a head rest to prevent sand or the like from blowing into the device. The end flap closure 44 is preferably made of a material with insulative properties to maintain temperatures within the device. End flap closure 44 may be formed of the same material as the rest of the cover 40, but end flap closure 44 is preferably padded such that it has a greater overall thickness. This allows end flap closure 44 to double as a pillow for the user by flipping it forward onto top wall 43, as shown in FIG. 1. This can be accomplished in either the extended or collapsed position. Preferably the end flap closure 44 is flexible to the extent that it can be pushed through the access opening 30 when the device is used as a carry bag. If not, end flap closure can be draped over either the top wall 43 to be out of the way or over the bottom wall 41 to act as a cover flap for the interior of the carry bag. In addition, the end flap closure 44 may be provided with a handle means 45, preferably comprising an aperture through the end flap closure 44 which allows the user to place fingers through the aperture so that the device can be easily grasped in one hand, with the end flap closure 44 extending upward from the remainder of the cover 40 when the device is used as a carry bag.

Figure 3:
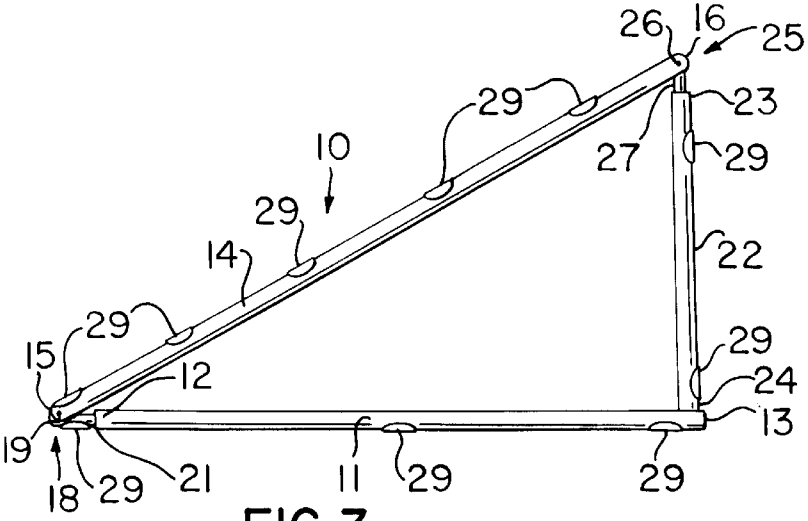
FIG. 3 is a side view of the frame assembly of a basic embodiment of the invention.
Figure 4:
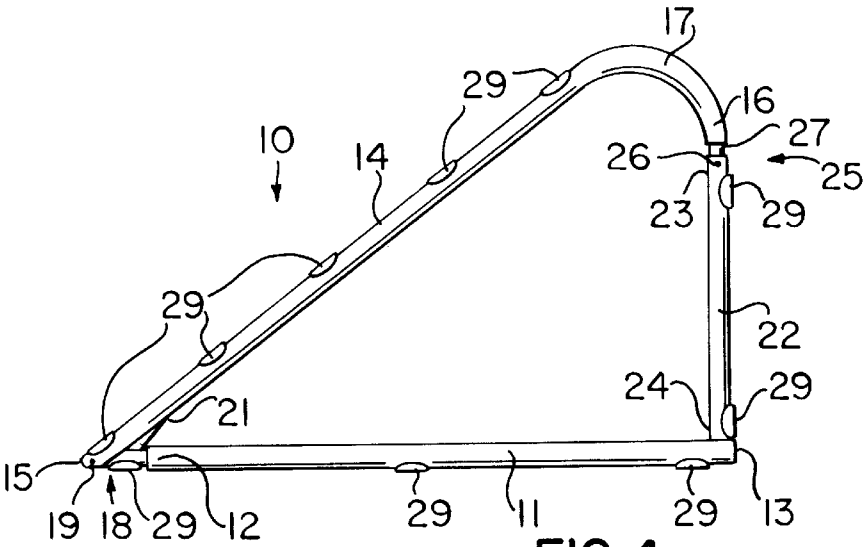
FIG. 4 is a side view similar to FIG. 3 of the frame assembly of the preferred embodiment of the invention.
Figure 5:
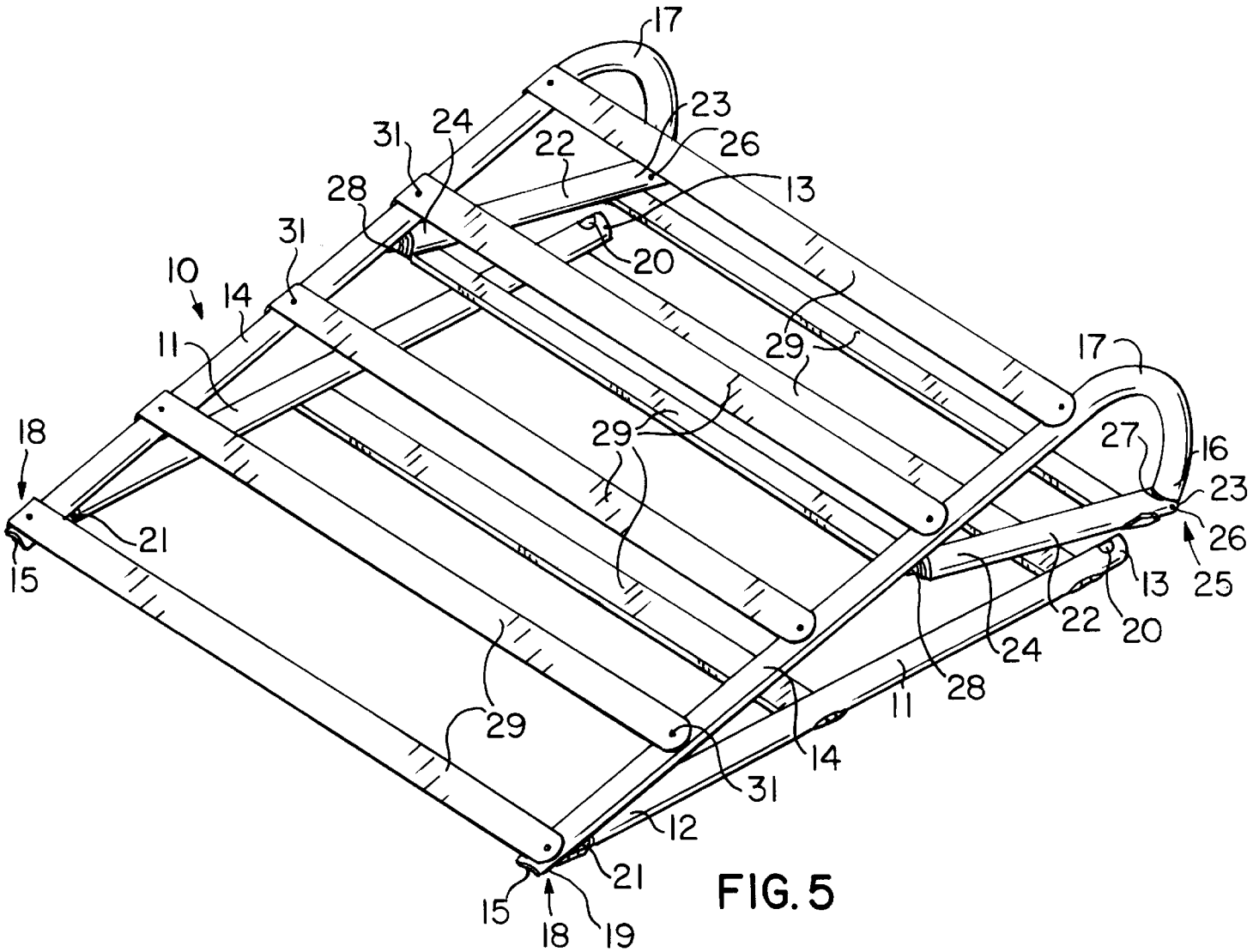
FIG. 5 is a perspective view similar to FIG. 1 of the frame assembly of the invention shown in the collapsed second position.
Figure 6:
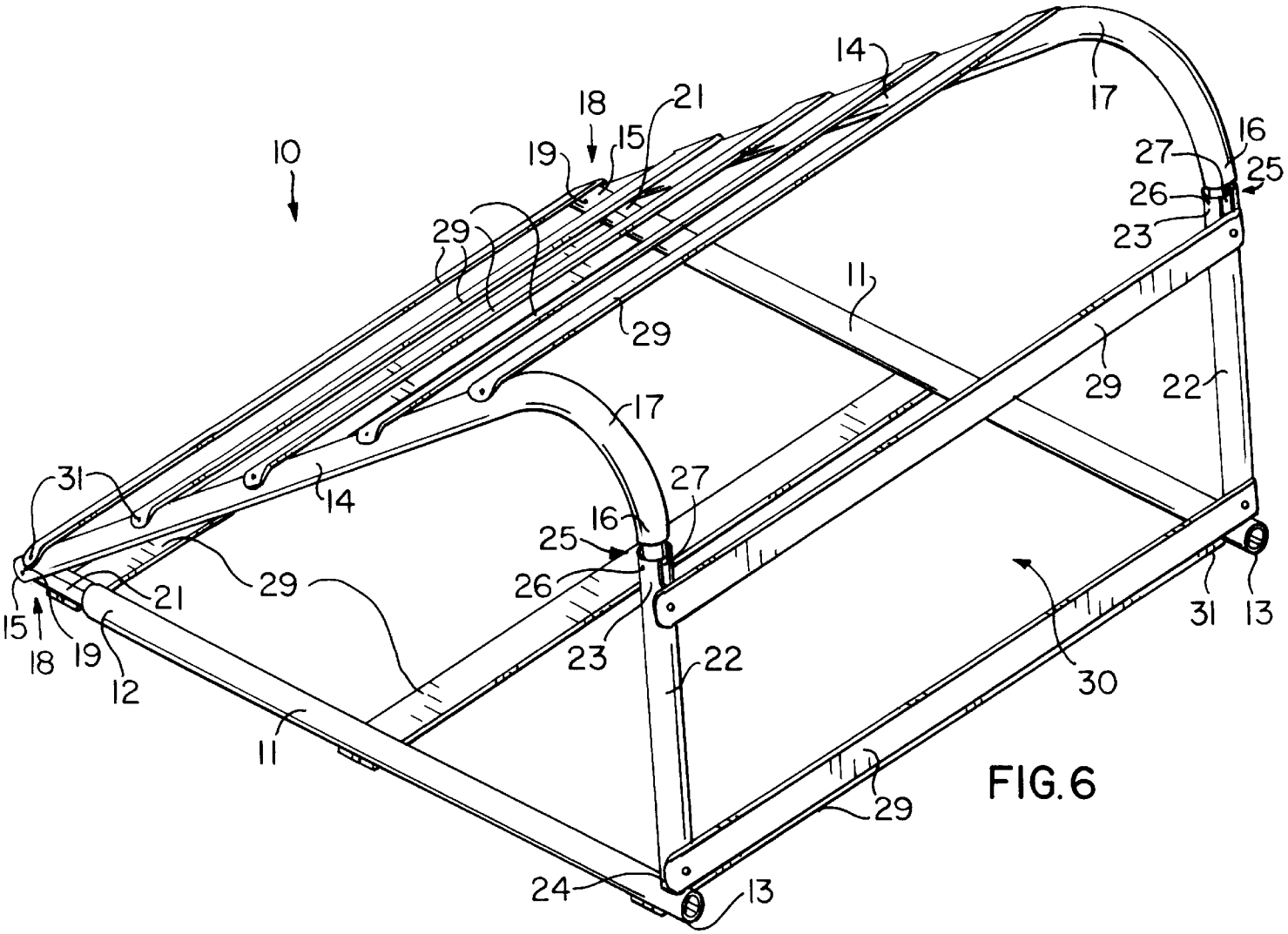
FIG. 6 is a perspective view similar to FIG. 2 of the frame assembly of the invention shown in the extended first position.

The cover 40 is preferably an external member which encloses and encases the relatively rigid frame assembly 10, although the device may be constructed with the various walls 41, 42 and 43 connected to the frame assembly 10 such that the frame assembly 10 is partially or completely exposed. The frame assembly 10, as shown in FIGS. 3 through 6, is composed of suitable structural materials such as metal or rigid plastic, preferably in the form of tubing, which are capable of supporting the weight of a user when the device is used as a head support. FIG. 3 shows a basic embodiment, while FIGS. 4 through 6 show a preferred embodiment. The frame assembly 10 comprises in general a pair of base members 11, a pair of head support members 14 and a pair of upright post members 22. Base members 11 are designated as such in that these components are positioned parallel to the ground when the device is used as a head support, head support members 14 are designated as such in that these components are positioned at an inclined position relative to the ground when the device is used as a head support, and upright post members 22 are designated as such in that these components are positioned generally vertically to the ground when the device is used as a head support and the post members 14 are connected to support the head support members 14 in the extended position with maximum incline angle. The pairs of base members 11, head support members 14 and post members 22 are each preferably in parallel, and are separated and fixed by a plurality of lateral brace members 29 connected by mechanical fasteners 31, welding or other suitable means. In this manner a sturdy wedge-shaped configuration is provided for the frame assembly 10. The frame assembly 10 may comprise a rigid structure, but preferably the frame assembly 10 is collapsible as set forth below.

Each base member 11 has a first end 12 and a second end 13, and each head support member 14 has a first end 15 and a second end 16. The base member first ends 12 are pivotally connected to the head support member first ends 14 by pivot means 18 at an acute angle, the pivot means 18 allowing the angle to be varied from a maximum angle when the frame assembly 10 is in the extended position, as shown in FIGS. 3, 4 and 6, to a minimum angle when the frame assembly 10 is in the collapsed position, as shown in FIG. 5. In the embodiment shown, the pivot means 18 comprises a base extension member 21 of reduced cross-sectional dimensions which extends from the first ends 12 of the base members 11, the base extension members 21 each laterally apertured to receive a pin member 19, where the first ends 15 of the head support members 14 are each slotted to receive the base extension members 21 and also laterally apertured to receive the pin members 19. Alternative equivalent mechanisms for pivot means 18 which allow the angle between the base members 11 and head support members 14 may be substituted for this particular construction.

Each of the upright post members 22 also comprises a first end 23 and a second end 24, where the post member first ends 23 are pivotally connected by post pivot means 25 to either the base member second ends 13 or the head support member second ends 16, the latter structure being illustrated in the drawings. Post pivot means 25 may comprise any suitable hinge or pivot mechanism which allows angular movement between the post members 22 and either the base members 11 or head support members 14 to which they are pivotally connected, but as shown comprises a post extension member 27 of reduced dimensions which extends from each post member first end 23 and is laterally apertured to receive a pin member 26, the head support member second ends 16 being slotted to receive the post extension members 27 and also laterally apertured to receive the pins 26, as shown in FIG. 3, or the post extension members 27 may extend from the second ends 16 of the head support members 14 with the first ends 23 of the post members 22 slotted and laterally apertured to receive the pins 26, as shown in FIGS. 4 through 6. The post pivot means 25 enables the post members 22 to be pivoted into the interior of the frame assembly 10 when in the disconnected state, as seen in FIG. 5. Connection means 32 are provided such that the second ends 24 of post members 22 can be joined to the other of either the head support member second ends 16 or the base member second ends 13, the latter being the preferred construction shown in the drawings. Connection means 32 comprise any suitable mechanism which allows the joined members to be disconnected when desired, but which provides for a sturdy connection when the members are joined. As shown, connection means 32 comprises an insertion post 28 of reduced diameter extending from each of the post member second ends 24, with corresponding post receiving apertures 20 positioned in the base member second ends 13, such that the insertion posts 28 can be inserted into the post receiving apertures 20 for secure connection ol the post members 14 to the base members 11, as shown in FIGS. 3, 4 and 6, which defines the extended position for the device where the head support members 14 and the top wall 43 of the cover 40 are in the position of maximum incline. The insertion posts 28 can be disconnected from the post receiving apertures 20 to allow the post members 22 to be pivoted into the interior of the frame assembly 10, as shown in FIG. 5.

This construction allows the device to be utilized in two positions, an extended position as shown in FIG. 2 where the angle between base members 11 and head support members 14 is maximized to provide a relatively steep incline to cover top wall 43, and a collapsed position as shown in FIG. 1, where the angle between base members 11 and head support members 14 is minimized to provide a relatively small incline to cover top wall 43, when the device is used as a head support. The collapsed position is also chosen when the device is used as a carry bag.

With the basic embodiment shown in FIG. 3, the frame assembly 10 will collapse to the minimum angle possible between the head support members 14 and the base members 11, as determined by the particular structure chosen for pivot means 18. There will be no support for the top wall 43 and head support member 14 at the second ends 16, meaning that significant undesirable stress may be placed on the frame assembly 10. To alleviate this problem, and to provide a more versatile structure, it is preferred that the head support members 14 be provided with shoulders 17 at or adjacent the second ends 24, with shoulders 17 being defined to be a connected structure which extends downward or a bend in the head support members 14 such that the second ends 24 extend downward, as shown in FIGS. 4 through 6. In this manner, as shown in FIG. 5, the head support member second ends 24 or the sides of the post member first ends 23 will rest on the ground when the frame assembly 10 is in the collapsed position, such that the head support members 14 are supported against the ground in an inclined position to preclude excessive stress on the pivot means 18 and to provide a second incline level when the device is used as a head support.

It is understood and contemplated that certain equivalent elements for the components set forth above may be obvious to those skilled in the art, and thus the true scope and definition of the invention is to be as set forth in the following claims.

I claim:

1. A generally wedge-shaped combination head support and carry bag device comprising a supporting frame assembly encased within a cover, said frame assembly comprising a pair of base members each having a first end and a second end, a pair of head support members each having a first end and a second end, where said first ends of said pair of head support members are joined to said first ends of said pair of base members at an acute angle by pivot means, and a pair of upright post members each having a first end and a second end, where said first ends of said pair of upright post members are joined to either said pair of base members or said pair of head support members by post pivot means, and where said second ends of said pair of upright post members are joined to either said pair of base members or said pair of head support members by connection means, such that said second ends of said pair of base members can be disconnected to allow said pair of upright post members to pivot into the interior of said frame assembly, and plural lateral brace members extending between said pair of base members and between said pair of head support members, said cover having a bottom wall extending between said pair of base members, a pair of side walls extending between each of said joined base members and said head support members, a top wall extending between said pair of head support members, and an access opening between said pair of upright post members, such that said frame assembly can be positioned in an extended position with said pair of upright post members connected to either of said pair of base members or said pair of head support members, and in a collapsed position with said pair of upright post members disconnected from either of said pair of base members or said pair of head support members and pivoted into the interior of said frame assembly.

2. The device of claim 1, where each of said head support members further comprises a shoulder such that said second ends of said head support members extend toward said second ends of said base members, such that said head support members are supported in an inclined position when said frame assembly is positioned in said collapsed position.

3. The device of claim 1, where said cover further comprises an end flap closure which covers said access opening.

4. The device of claim 3, where said end flap closure is padded.

5. The device of claim 3, where said end flap closure further comprises a handle.

6. The device of claim 1, where said connection means comprises an insertion post positioned on each said second end of said upright post members and a post receiving aperture positioned on each said second end of either said base members or said head support members, said post receiving apertures receiving said insertion posts in a removable manner.

7. The device of claim 1, where said pivot means comprises a base extension member extending from each said first end of said base members and a pin extending through each said first end of said head support members, where said first ends of said head support members are slotted to receive said base extension members.

8. The device of claim 1, where said post pivot means comprises a post extension member extending from each said first end of said upright post members and a pin extending through each said second end of either said head support members or said base members, where said second ends of either said head support members or said base members are slotted to receive said post extension members.

9. The device of claim 2, where said cover further comprises an end flap closure which covers said access opening.

10. The device of claim 9, where said end flap closure is padded.

11. The device of claim 10, where said end flap closure further comprises a handle.

12. The device of claim 2, where said connection means comprises an insertion post positioned on each said second end of said upright post members and a post receiving aperture positioned on each said second end of either said base members or said head support members, said post receiving apertures receiving said insertion posts in a removable manner.

13. The device of claim 2, where said pivot means comprises a base extension member extending from each said first end of said base members and a pin extending through each said first end of said head support members, where said first ends of said head support members are slotted to receive said base extension members.

14. The device of claim 2, where said post pivot means comprises a post extension member extending from each said first end of said upright post members and a pin extending through each said second end of either said head support members or said base members, where said second ends of either said head support members or said base members are slotted to receive said post extension members.

15. A generally wedge-shaped combination head support and carry bag device comprising a supporting frame assembly encased within a cover, said frame assembly comprising a pair of base members each having a first end and a second end, a pair of head support members each having a first end and a second end, where said first ends of said pair of head support members are joined to said first ends of said pair of base members at an acute angle, and a pair of upright post members each having a first end and a second end, where said first ends of said pair of upright post members are joined to said pair of base members and where said second ends of said pair of upright post members are joined to said pair of head support members, and plural lateral brace members extending between said pair of base members and between said pair of head support members, said cover having a bottom wall extending between said pair of base members, a pair of side walls extending between each of said joined base members and said head support members, a top wall extending between said pair of head support members, and an access opening between said pair of upright post members, wherein the combination of said bottom wall, said pair of side walls and said top wall of said cover defines an enclosed interior adapted to receive and carry objects.

16. The device of claim 15, where said cover further comprises an end flap closure which covers said access opening.

17. The device of claim 16, where said end flap closure is padded.

18. The device of claim 16, where said end flap closure further comprises a handle.

* * * * *